US009377186B2

(12) United States Patent
Verhoeven et al.

(10) Patent No.: US 9,377,186 B2
(45) Date of Patent: Jun. 28, 2016

(54) END CAP FOR A TUBULAR LIGHT SOURCE

(75) Inventors: Mark Verhoeven, Eindhoven (NL); Vincent Gielen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 191 days.

(21) Appl. No.: 14/006,988

(22) PCT Filed: Mar. 16, 2012

(86) PCT No.: PCT/IB2012/051274

§ 371 (c)(1),
(2), (4) Date: Sep. 24, 2013

(87) PCT Pub. No.: WO2012/131522

PCT Pub. Date: Oct. 4, 2012

(65) Prior Publication Data

US 2014/0009925 A1 Jan. 9, 2014

(30) Foreign Application Priority Data

Mar. 30, 2011 (EP) ..... 11160372

(51) Int. Cl.
*F21V 25/00* (2006.01)
*F21V 19/00* (2006.01)
(Continued)

(52) U.S. Cl.
CPC ..... *F21V 25/00* (2013.01); *F21K 9/175* (2013.01); *F21V 19/008* (2013.01); *F21V 23/04* (2013.01); *H01R 13/71* (2013.01); *H01R 33/96* (2013.01); *F21K 9/17* (2013.01); *F21V 25/02* (2013.01); *F21Y 2101/02* (2013.01)

(58) Field of Classification Search
CPC ..... H01R 33/08
USPC ..... 362/221, 217.01, 217.08, 219; 439/226, 439/239
See application file for complete search history.

(56) References Cited

U.S. PATENT DOCUMENTS 6,837,592 B1 * 1/2005 Dahlen ..... 362/224
7,602,112 B2 * 10/2009 Peeters et al. ..... 313/318.07
(Continued)

FOREIGN PATENT DOCUMENTS

DE 202010008186 U1 10/2010
GB 0507549 10/1938
(Continued)

OTHER PUBLICATIONS

Machine Translation of WO 2009/154162, May 22, 2015.*
(Continued)

*Primary Examiner* — Evan Dzierzynski
*Assistant Examiner* — Christopher E Dunay

(57) ABSTRACT

An end cap (104) for a tubular light source (102), the tubular light source (102) configured to be arranged in a lighting fixture (106) comprising at least one socket (108), wherein the end cap (104) comprises, a first housing portion (202), two connector pins (208) at least partly arranged on an outside of the first housing portion (202) and adapted to fit in the socket (108), and a switch assembly comprising a switch element, wherein the switch assembly being adapted to form a conductive path between the socket (108) and the tubular light source (102) through a depression of the switch element in combination with a relative rotational motion of the first housing portion (202) in relation to the tubular light source (102) as the tubular light source (102) is mounted in the fixture (106).

14 Claims, 6 Drawing Sheets

(51) Int. Cl.

| | |
|---|---|
| ***F21V 23/04*** | (2006.01) |
| ***H01R 13/71*** | (2006.01) |
| ***H01R 33/96*** | (2006.01) |
| *F21K 99/00* | (2016.01) |
| *F21V 25/02* | (2006.01) |
| *F21Y 101/02* | (2006.01) |

(56) References Cited

U.S. PATENT DOCUMENTS

| | | | | |
|---|---|---|---|---|
| 8,894,430 | B2 * | 11/2014 | Simon et al. | 439/226 |
| 2009/0159919 | A1 * | 6/2009 | Simon et al. | 257/99 |
| 2010/0018178 | A1 | 1/2010 | Fink | |
| 2010/0270925 | A1 | 10/2010 | Withers | |
| 2012/0106157 | A1 * | 5/2012 | Simon | F21V 25/04 362/249.05 |
| 2012/0212951 | A1 * | 8/2012 | Lai et al. | 362/218 |
| 2013/0127327 | A1 * | 5/2013 | Heil et al. | 313/313 |

FOREIGN PATENT DOCUMENTS

| | | | |
|---|---|---|---|
| GB | 0535827 | | 10/1940 |
| GB | 0531063 | | 12/1940 |
| GB | 0536625 | | 5/1941 |
| GB | 0610984 | | 10/1948 |
| JP | 04488649 | | 11/2002 |
| JP | 2009043447 | A | 2/2009 |
| WO | WO 2009154162 | A1 * | 12/2009 |
| WO | 2010069983 | A1 | 6/2010 |

OTHER PUBLICATIONS

"LED Fluorsecent-Tube With Rotatab" Web Site: http://www.hccled.com/news/36/LED-Fluorescent-Tube-with-Rotatable-End-Caps, the . . . Oct. 25, 2010.

* cited by examiner

END CAP FOR A TUBULAR LIGHT SOURCE

CROSS-REFERENCE TO PRIOR APPLICATIONS

This application is the U.S. National Phase application under 35 U.S.C. §371 of International Application No. PCT/IB2012/051274, filed on Mar. 16, 2012, which claims the benefit of and priority to European Patent Application No. 11160372.6, filed on Mar. 30, 2011. These applications are hereby incorporated by reference herein.

FIELD OF THE INVENTION

The present invention relates to an end cap for a tubular light source, and in particular to an end cap enabling safe installation of such a tubular light source.

BACKGROUND OF THE INVENTION

Fluorescent lighting tubes are commonly used in a large range of lighting systems as a result of advantages such as longer life time and better luminous efficiency compared to incandescent lamps. However, in the continuous effort to reduce power consumption, it is desirable to replace conventional light tubes with still more energy efficient and environmental friendly alternatives. One such alternative is to use LED tubular light sources having a plurality of LED's arranged in a tube similar to the fluorescent tube. In order to facilitate a transition from fluorescent tube lights to LED tubular light sources, the LED tubular light sources should be configured to be mounted in already existing fixtures for fluorescent light tubes. However, the electrical circuitry is different in an LED tubular light source compared to in a fluorescent light tube in that the LED tube may provide a current path between the two end caps. As a result, installation of retrofitted LED tubular light sources may be a safety hazard as it is possible to first install one end cap in the mains connected fixture while having the other end cap still exposed and carrying a live potential on the connection pins of the exposed cap. Thus, the installer may touch the exposed end cap and get an electrical shock.

US2010/018178 discloses a suggestion on how the aforementioned safety issue may be alleviated by introducing a safety switch in the end cap of the LED tubular light source. However, a push-in safety switch according to US2010/018178 may in some cases be unintentionally engaged when the installer is pushing a first end of the tubular light source as a second end is inserted into the fixture, thereby exposing the installer to potential hazard as the unconnected end cap may then have a live potential. Furthermore, the installer may gain a false sense of security as the presence of a safety switch may make the installer believe that installation is safe in all circumstances.

Therefore, there is a need for an improved safety mechanism to improve the safety for the installer when installing retrofitted LED tubular light sources.

SUMMARY OF THE INVENTION

In view of the aforementioned and other drawbacks of prior art, it is an object of the present invention to improve the safety when installing a tubular light source, in particular it is an object to provide an end cap for a tubular light source comprising LEDs, the end cap further comprising a safety switch to facilitate safe installation of the tubular light source in a fixture.

According to an aspect of the present invention, it is therefore provided an end cap for a tubular light source, the tubular light source configured to be arranged in a lighting fixture comprising at least one socket, wherein the end cap comprises a first housing portion, two connector pins at least partly arranged on an outside of the housing and adapted to fit in the socket, and a switch assembly comprising a switch element, wherein the switch assembly being adapted to form a conductive path between the socket and the tubular light source through a depression of the switch element in combination with a relative rotational motion of the first housing portion in relation to the tubular light source as the tubular light source is mounted in the fixture.

The present invention is based on the realization that a safety switch for a tubular light source may advantageously be integrated into the end cap of the tube and that the safety switch preferably is automatically closing an electrical circuit by forming a conductive path between the socket and the tubular light source during installation of such a light source. In particular, in some tubular light sources, the internal circuitry is arranged so that the light source may provide a conductive path from the connector pins in one end portion of an elongate tube to connector pins in the opposite end portion even if the light source is not active contrary to what was possible in conventional fluorescent light tubes. In other words, it is possible that mounting one end portion of the tubular light source in the socket of the lighting fixture leads to the connector pins in the opposite end portion carrying a live voltage. In particular, having a push-in mechanism arranged on the end cap may cause the installer to unintentionally push the safety mechanism, thereby engaging the electrical circuit, during installation of the tubular light source. By having a switch which automatically closes an electrical circuit only when the connector pins are out of reach for the installer, the risk for the installer of receiving an electrical shock when installing a tubular light source is significantly reduced. A further advantage of the present invention is that a double safety feature is provided which is integrated in an end cap for a tubular light source. The double safety feature is provided through a switch assembly where the electrical circuit is closed only through a combination of a push-movement of the switch element and a rotational movement of either the end cap or the tubular light source. One way to mount a tube light in a fixture is to first push the pins into the socket, thereby simultaneously engaging the push part of the safety switch. Thereafter the tubular light source may be rotated, either as a part of the mounting procedure as is the case for some fixtures or as a separate second step operative to close the electrical circuit from one end portion of the tubular light source to the other. In the first case, the circuit is closed as a part of the mounting procedure and in the second case an additional rotational motion is required, either way provides a double safety feature requiring two steps to close the electrical circuit. An additional advantage is that the end cap according to the present invention is compatible with and thereby provides safety for a plurality of different sockets. As an example, the end cap may be used in fixtures equipped with either of G5 and G13 type lamp sockets.

According to one embodiment, the end cap may advantageously comprise a second housing portion rotationally movable in relation to the first housing portion, wherein the conductive path is formed through a rotation of the second housing portion in relation to the first housing portion when the switch element is depressed.

Additionally, the second housing portion may be at least partially arranged inside the first housing portion.

Furthermore, the end cap may comprise conductive receiving means arranged in the second housing portion and configured to receive the connector pins through a rotation of the second housing portion in relation to the first housing portion, and wherein the electrically conductive receiving means are configured to be axially aligned with the connector pins only when the switch element is depressed. Consequently, the connector pins may preferably extend into the second housing portion where the connection between the pins and the receiving means is made. The electrically conductive receiving means may advantageously be arranged on a plate which in turn is mechanically connected to the axially movable switch element. The axial alignment of the electrically conductive receiving means and the connector pins thereby enables the connection between the socket and the light source as the end cap is mounted. Thus, if the rotational movement is performed without the switch element being depressed, there would be no electrical contact between the connector pins and the light source as the electrically conductive receiving means would be positioned in another axial plane. Additionally, spring means may advantageously be connected to the plate or the switch element in order to return the switch element to an un-pressed position when no external pressure is applied. The spring means may be a coil spring connected to the plate, but it may equally well be any other elastic element arranged to return the switch element to an un-pressed position.

In one embodiment, the switch element at least partly arranged on the outside of the housing may advantageously be a peg protruding in between the two connector pins. Having a peg or any similar structure protruding between the connector pins provides a simple way to depress the peg as the end cap is installed into a fixture, thereby performing the first step in the two-step process of creating a conducting path. The peg is preferably designed and configured so as to ensure that it is depressed when mounted in the intended fixture. The switch element should furthermore be activated at a relatively high force in order to reach a higher safety level as it may be possible for the installer to apply some force on the switch element during installation, thereby accidentally depressing the switch element.

In one embodiment, the second housing portion may advantageously be connected to the first housing portion by spring means acting in a rotational direction, the spring means being configured to return the relative rotational position of the first and second housing portions to an idle position. The spring means are operative to return the relative rotational position of the inner and the first housing portion in the case where the switch element is not depressed. However, the force of the electrically conductive receiving means in the rotational direction is preferably larger than the aforementioned spring force between the inner and first housing portion in order to maintain a conductive path between connector pins and the electrically conductive receiving means after a rotation has been performed while the switch element was depressed. The spring means may be coil springs, leaf springs, elastic elements or any similar structure.

Furthermore, the tubular light source is preferably mechanically fixed with the second housing portion. An advantage of fixing the tubular light source to the second housing portion is that installation is simplified as it is possible to rotate the entire tubular light source when mounting the tubular light source in a fixture.

In one embodiment of the invention, the electrically conductive receiving means may advantageously be spring clips. Furthermore, the spring clips may be adapted to the diameter of the end portions of the connector pins so that the connector pins are fixed in a rotational direction if a rotational motion has been performed and if the rotational force is sufficiently large to engage the connector pins in the spring clip. On the other hand, the spring clips should not fix the connector pins in an axial direction in the case where the switch element is depressed but released again. Thus, the axial alignment of the receiving means and the connector pins should not be maintained by a force from the spring clips acting in an axial direction. Consequently, the force of the spring means acting on the plate and switch element in an axial direction should be larger than the frictional force of the spring clips acting in the axial direction. The electrically conductive receiving means may equally well be any structure or arrangement filling the function of the spring clips described above. Furthermore, the spring clips may be equipped with caps or similar devices preferably made from an insulating material such that no electrical connection is formed in the case when the first and second housing portions are rotated in relation to each other while the switch element is not depressed.

In one embodiment, the connector pins may advantageously be cylindrical having an end portion with a larger diameter configured to connect to the electrically conductive receiving means.

According to one embodiment, at least one end cap as discussed above may advantageously be arranged on at least one end of a tubular illuminator part comprising a plurality of light emitting elements in order to form a tubular light source. Furthermore, such a tubular light source may advantageously be provided with an appropriate fixture comprising at least one socket for receiving the at least one end cap and for connecting the tubular light source to an electrical power supply, thereby forming a luminaire. Additionally, the tubular light source may advantageously comprise optics configured to mix light. Such optics may be any mixing and/or collimating means. Light mixing optics may advantageously be used if the light emitting elements comprise LEDs. However, the light emitting elements may be any light source such as a fluorescent or incandescent light source.

According to another aspect, it is provided an end cap for a tubular light source, the tubular light source configured to be arranged in a lighting fixture comprising at least one socket, wherein the end cap comprises a first housing portion, two connector pins at least partly arranged on an outside of the housing and adapted to fit in the socket, and a second housing portion rotationally movable in relation to the first housing portion, wherein a conductive path between the socket and the tubular light source is formed through a rotation of the second housing portion in relation to the first housing portion.

Effects and features of this aspect of the invention are largely analogous to those described above in connection with the first aspect of the invention. However, an additional advantage of this aspect is that an end cap providing safe installation of a tubular light source can be achieved in a simple way at a low cost. In some applications, an end cap providing single safety may be sufficient.

BRIEF DESCRIPTION OF THE DRAWINGS

These and other aspects of the present invention will now be described in more detail with reference to the appended drawings showing currently preferred embodiments of the invention, wherein.

DETAILED DESCRIPTION

Figure 1A:
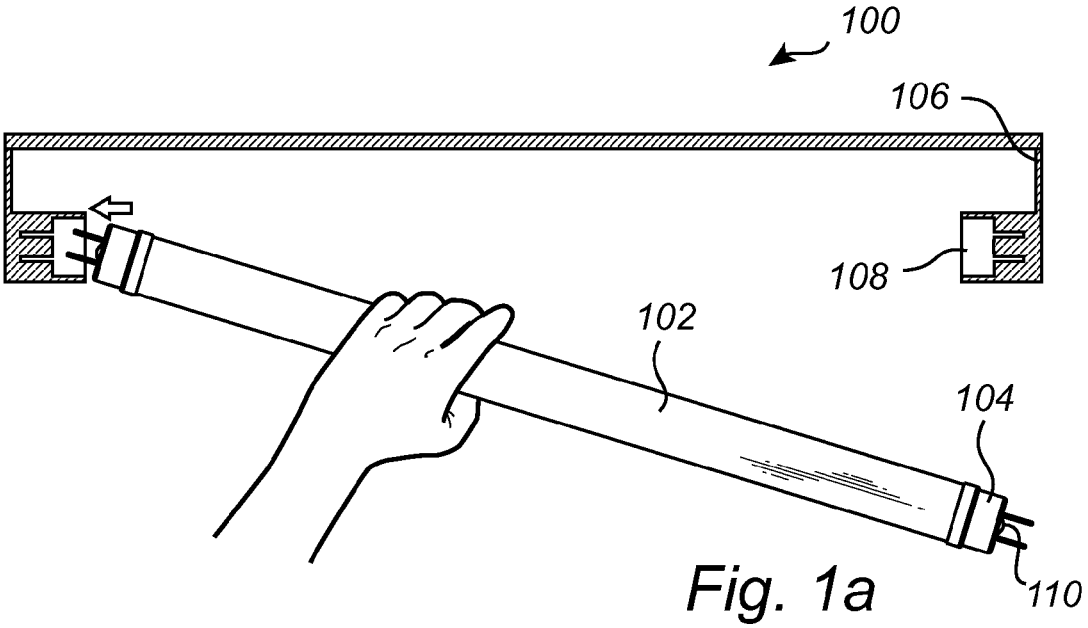
FIGS. 1*a* to 1*c* are schematically illustrating an exemplary mounting procedure of a tubular light source.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

In the following, various embodiments of an end cap according to the present invention are mainly discussed with reference to an end cap for a tubular light source providing safety through a two-step mechanism including both an axial and a rotational motion. It should be noted that this by no means limits the scope of the present invention which is equally applicable to safety mechanisms for end caps where safety is provided by means of a first housing portion and a second housing portion being rotational in relation to each other.

Figure 1B:
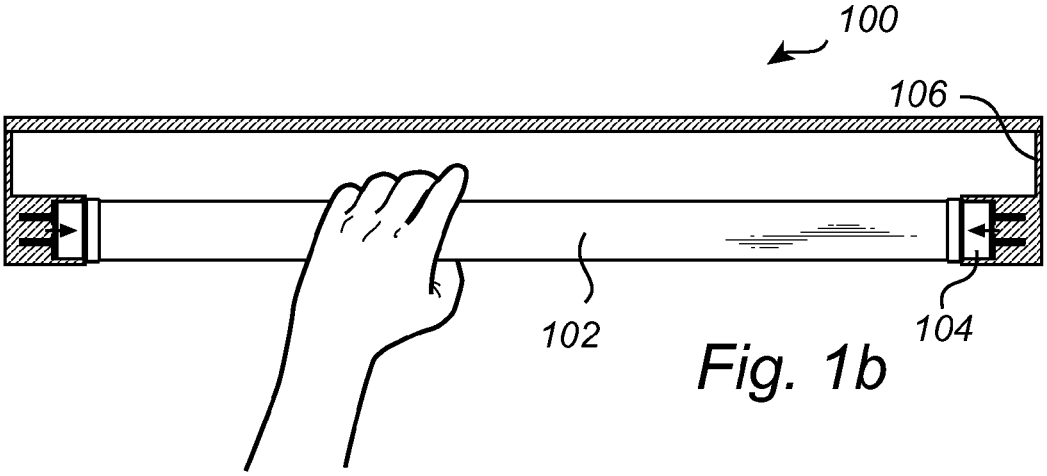
Figure 1C:
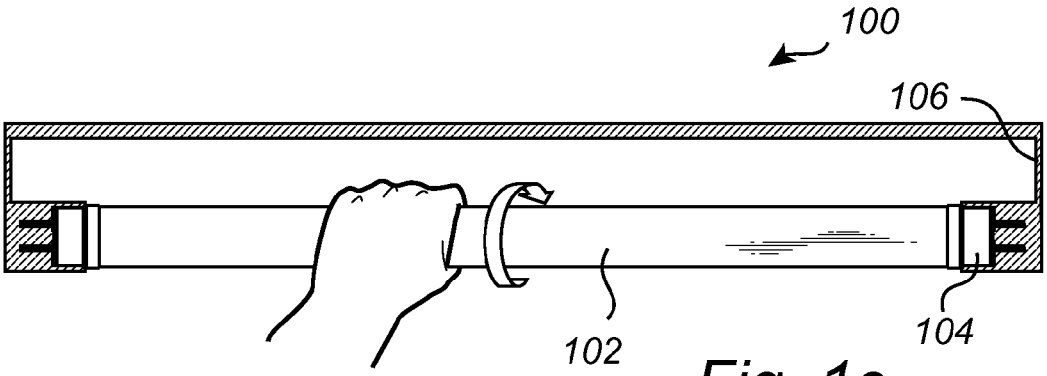

FIG. 1 schematically illustrates a luminaire 100 wherein a tubular light source 102 comprising an end cap 104 according to the present invention is being mounted into a mains connected fixture 106. As illustrated in FIG. 1*a*, one end cap 104 is first inserted into a socket 108 arranged in the fixture 106, thereby depressing a switch 110 arranged on the outside of the end cap 104. Next, as depicted in FIG. 1*b*, the opposing end cap 104 of the light source 102 is inserted into the opposing socket 104. After that, the mounting is completed by rotating the tubular light source 102 as illustrated in FIG. 1*c*. The rotation may, depending on the configuration of the socket 104, be either a rotation of the tubular light source 100 in relation to the end cap 104 and/or it may be a rotation of the end cap 104 in relation to the socket 108. Both the push and rotate motions are required to activate the safety mechanism which is operative to engage the electrical circuit of the luminaire 100. It should also be noted that while the tubular light source 102 is currently illustrated with end caps 104 in both ends, the two-step safety feature will also be provided in the case where the tubular light source 102 is equipped with only one end cap 104 according to the present invention.

Figure 2A:
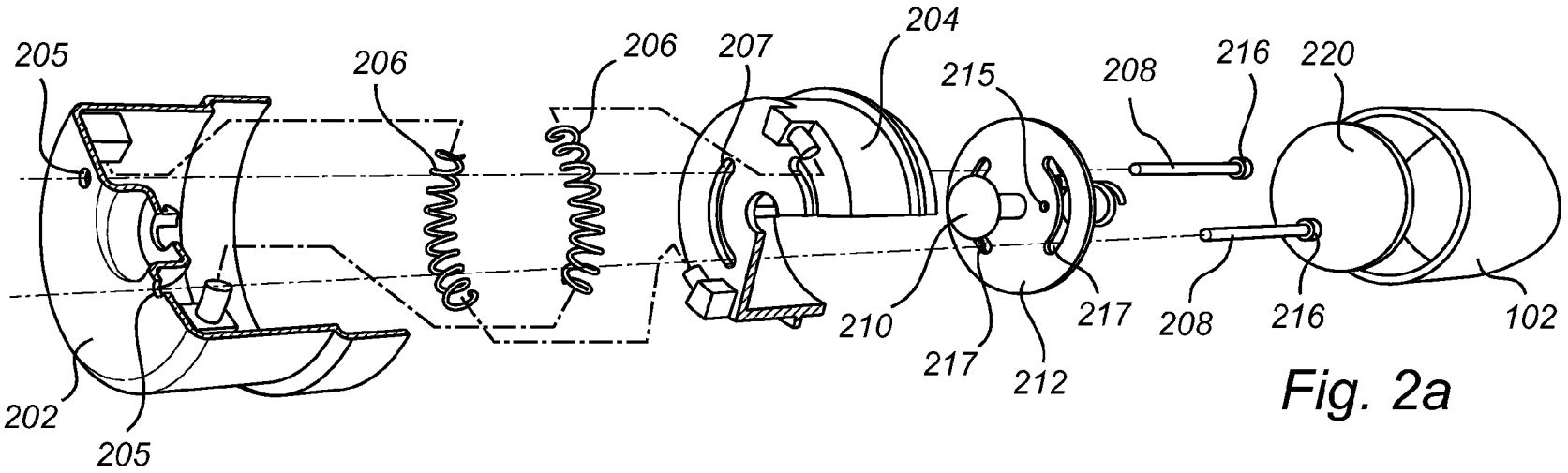
FIGS. 2*a* and 2*b* are schematic illustrations showing exploded views of an end cap for a tubular light source according to an embodiment of the invention.
Figure 2B:
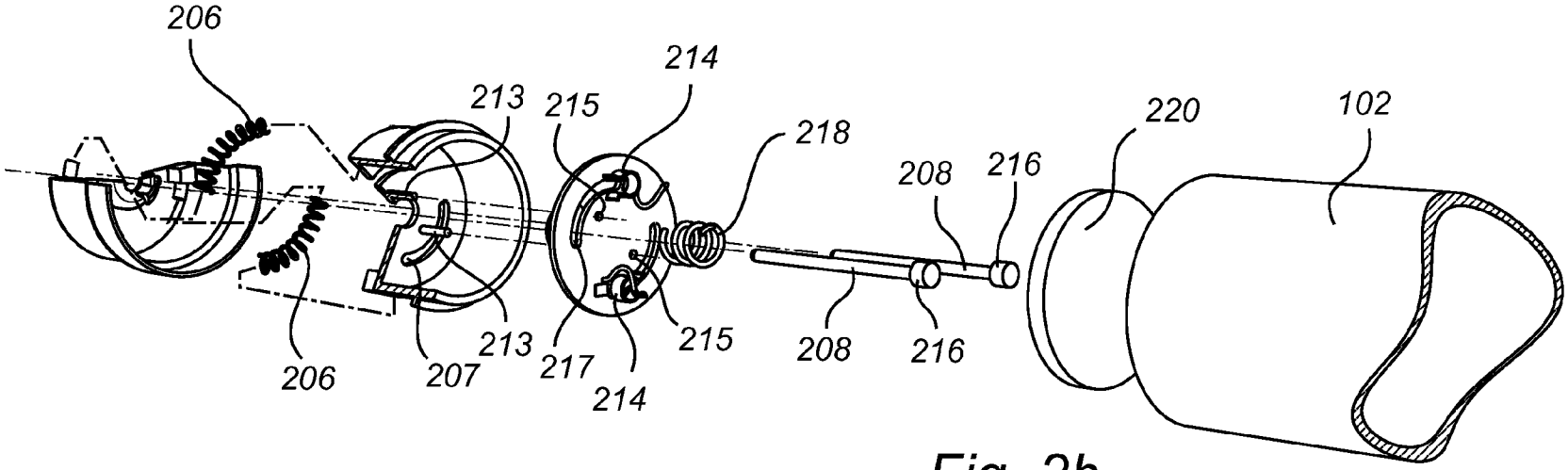

FIGS. 2*a* and 2*b* are exploded views in two different perspectives schematically illustrating en exemplary end cap 104 according to the present invention.

A currently preferred embodiment will now be described with reference to FIG. 2 in conjunction with FIG. 3 showing a sectional view of the end cap. The end cap comprises a first housing portion 202 and a second housing portion 204 which is axially rotatable in relation to the first housing portion 202. The second housing portion 204 is mechanically connected to the tubular light source 102. The first 202 and second 204 housing portions are further connected through coil springs 206 acting in an axially rotational direction so as to return the relative rotational position of the first 202 and second 204 housing portions to an idle position when no external rotational force is applied. Two electrically conductive connector pins 208 adapted to fit into the socket 108 are arranged so that a portion of the connector pins 208 are protruding from the outside of the first housing portion 202 through openings 205 in the first housing portion 202 and another portion is arranged inside the second housing portion 204. In the second housing portion 204, the openings 207 for the connector pins 202 are elongate to allow for a certain degree of rotation of the second housing portion 204 in relation to the connector pins 208 and the first housing portion 202. Next, a peg 210 is arranged so as to be located in between the connector pins 208 on the outside of the first housing portion 202, the peg 210 further extending into the second housing portion 204 where the peg 201 is mechanically connected to a plate 212.

There are also holding pins 213 arranged in the second housing portion 204 with corresponding openings 215 in the plate 212 for receiving the holding pins 213 in order to fix the plate 212 to the second housing portion 204 in an axially rotational direction while allowing axial movement of the second housing portion 204 in relation to the plate 212. The plate 212 further comprises elongate openings 217 configured to allow the plate 212 to be axially rotatable in relation to the connector pins 208. Furthermore, spring clips 214 are arranged on the side of the plate 212 facing the tubular light source 102. The end portions 216 of the connector pins 208 facing the tubular light source 102 have a larger diameter and are configured to engage the spring clips 214 upon rotation of the plate 212 in relation to the connector pins 208. The spring clips 214 are configured to be axially aligned with the end portions 216 of the connector pins 208 when the peg 210 is depressed and where the plate 212 is consequently moved in an axial direction. The larger diameter of the end portions 216 of the connector pins 208 is required so as to avoid that the connector pins 208 are engaging the spring clips 214 in the case where a relative rotation is performed while the peg 210 is not depressed.

A coil spring 218 is also arranged between the plate and a holding element 220. The coil spring 218 is configured to return the peg 210 and plate 212 to an idle position when no external force is applied. The force required to compress the coil spring 218 when depressing the peg 210 should be sufficiently high so that the peg may not easily be accidentally depressed by the installer during installation.

Figure 3A:
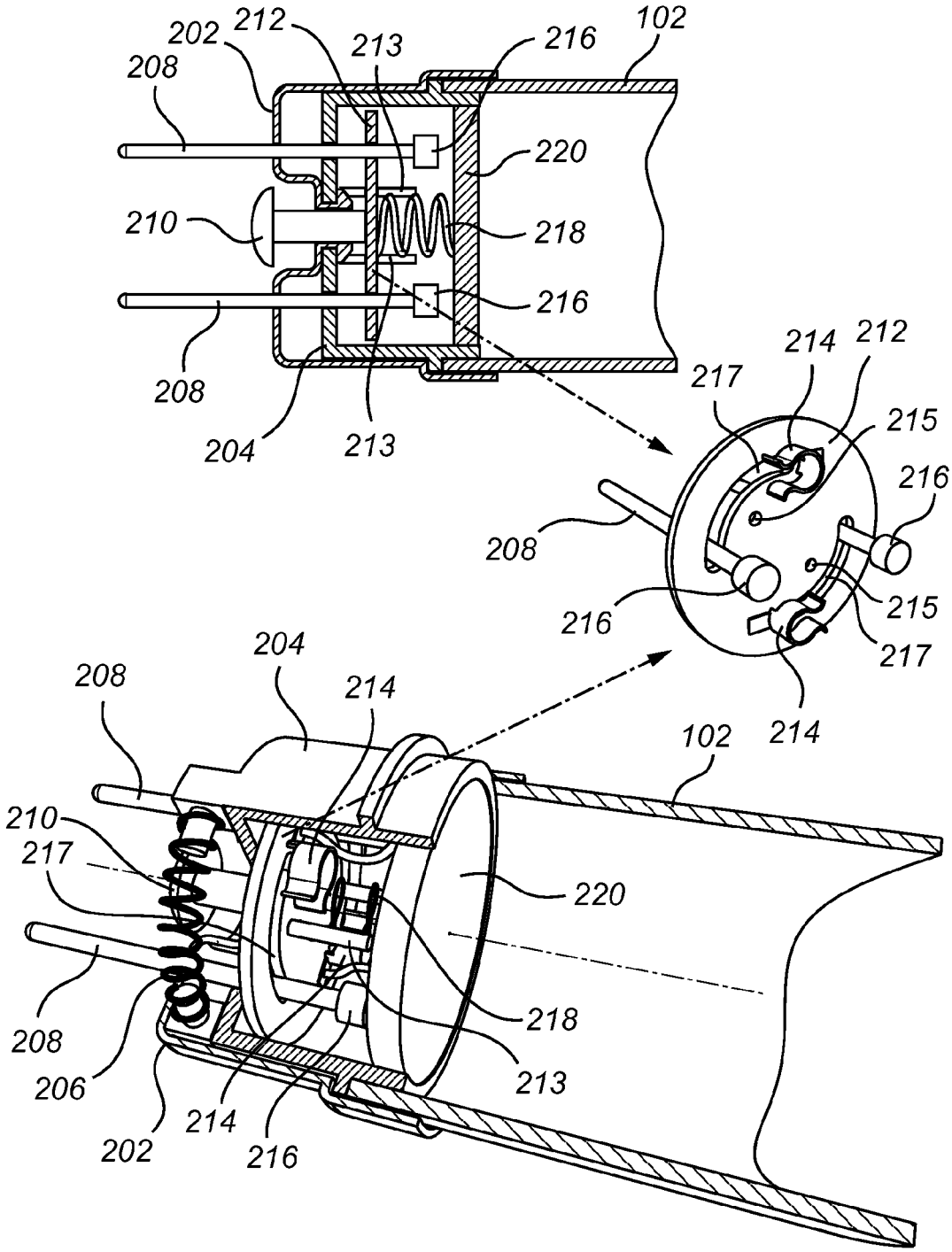
FIGS. 3*a* to 3*c* schematically illustrate an end cap for a tubular light source according to an embodiment of the invention.
Figure 3B:
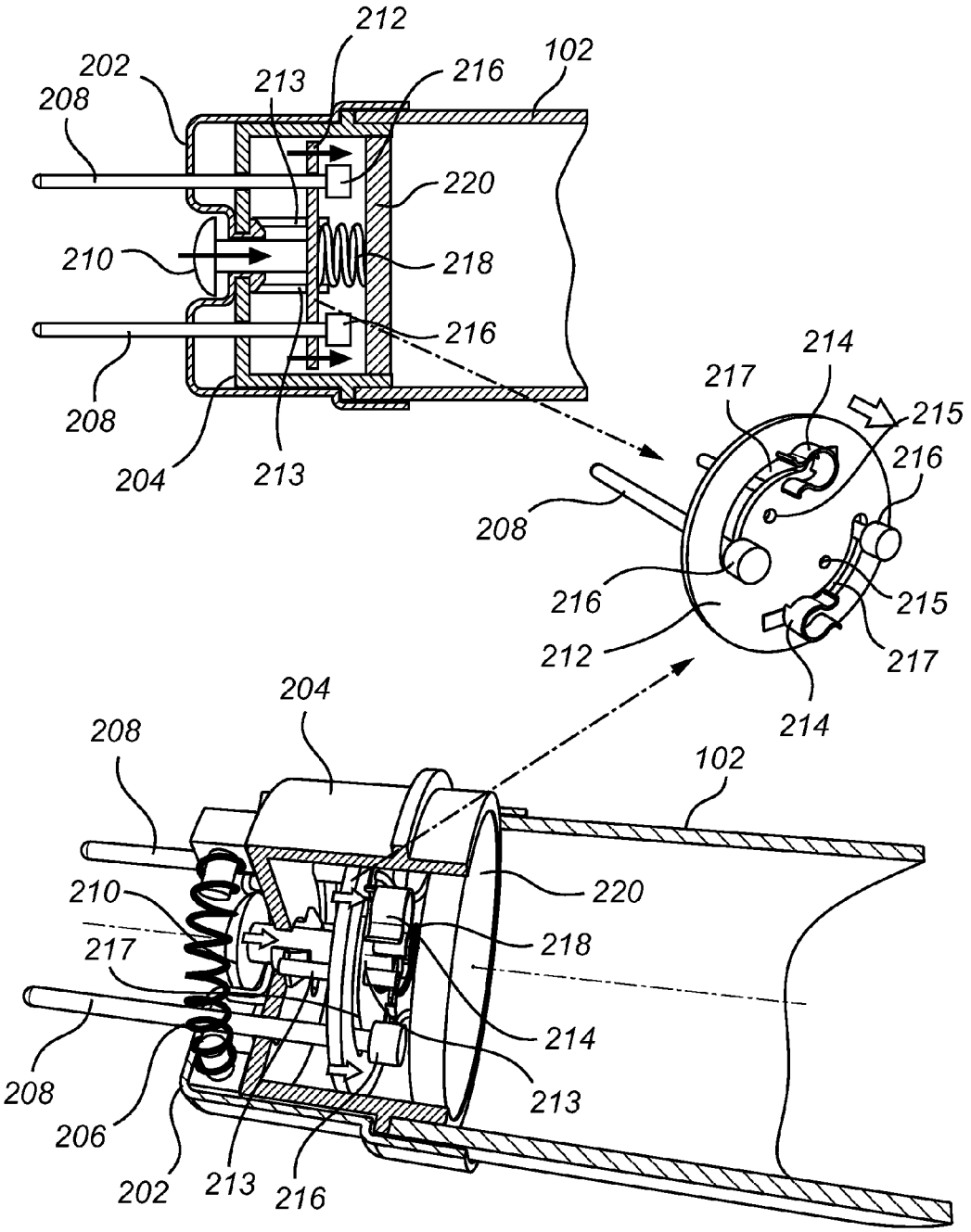
Figure 3C:
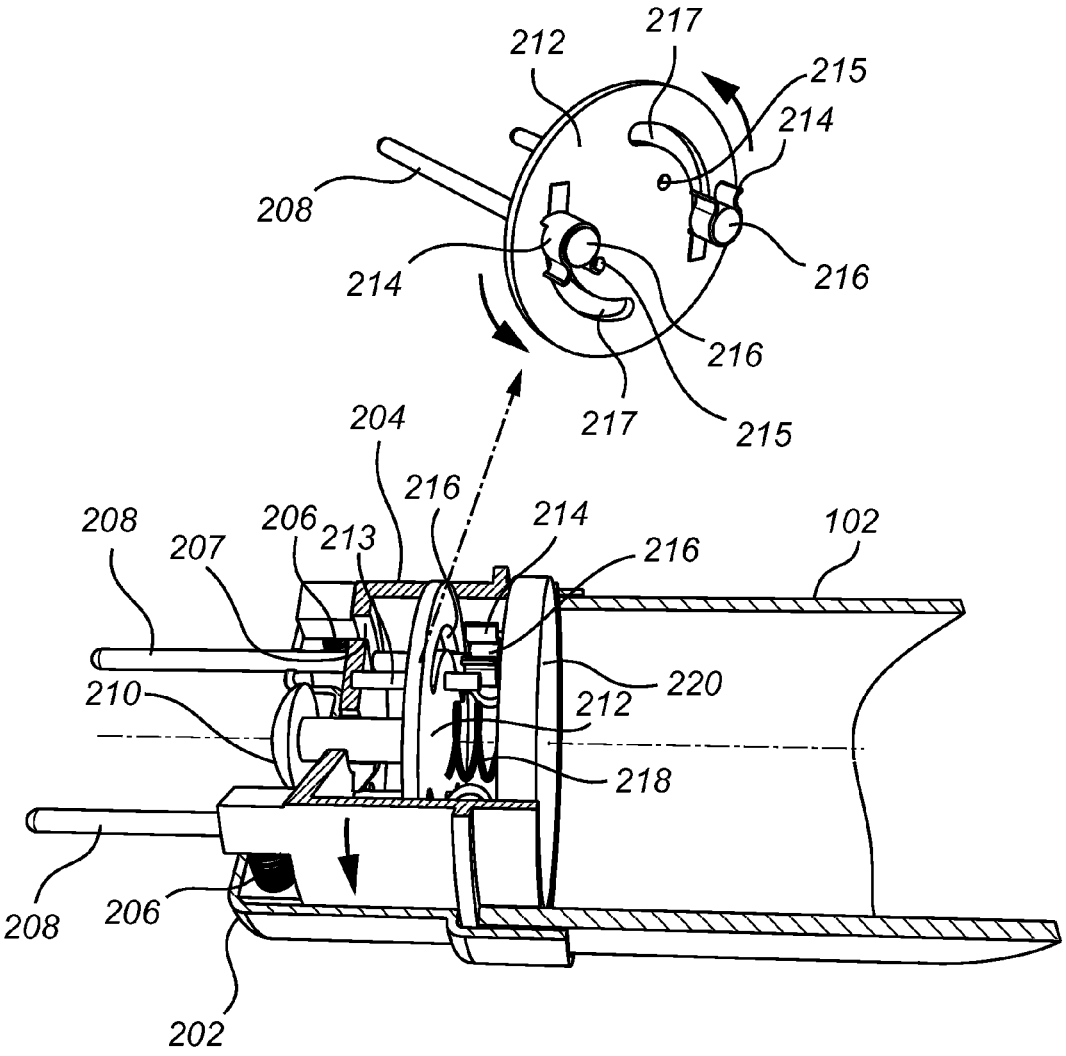

FIGS. 3*a* to 3*c* illustrate the end cap switch assembly more clearly in relation to the different mounting steps illustrated in FIG. 1. FIG. 3*a* corresponds to FIG. 1*a* where the end cap 120 is in an idle position. In FIG. 3*b*, corresponding to FIG. 1*b*, the peg 210 is depressed and through the movement of the peg 210 and plate 212 in the axial direction the spring clips 214 on the plate 212 becomes axially aligned with the end portions 216 of the connector pins 208. In the next step, as shown in FIG. 3*c* corresponding to FIG. 1*c*, a rotation of the tubular light source 102 and thereby a rotation of the second housing portion 204 in relation to the first housing portion 202 and the socket 108 is performed. Through the rotation, the end portions 216 of the connector pins 208 engage the spring clips 214 thereby closing forming a conductive path between the mains connected socket 108 and the tubular light source 102. The spring clips 214 may be connected to any intermediate control circuitry required to operate the tubular light source 102.

Figure 4A:
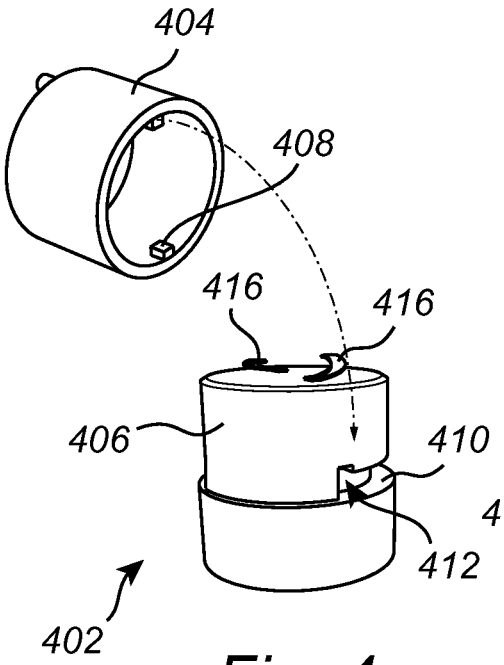
FIGS. 4*a* and 4*b* schematically illustrate an exemplary embodiment of an end cap according to the present invention.
Figure 4B:
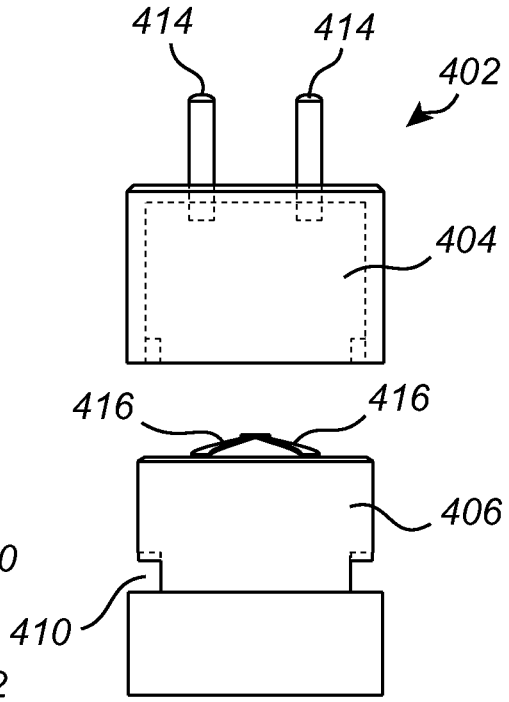

FIGS. 4*a* and 4*b* schematically illustrate an alternative embodiment of an end cap 402 according to the present invention. The end cap comprises a first 404 and a second 406 housing portion and the first housing portion 404 is arranged partly overlapping the second housing portion 406. The first 404 and second 406 housings may further be connected by spring means (not shown) both in the axial and in the rotational direction. One or more protrusions 408 at the inside of the first housing are configured to be arranged in a groove 410 extending along the circumference of the second housing portion 406 so as to connect the two housings while allowing relative rotational movement. The groove 410 is further configured to have an additional groove portion 412 extending in the axial direction and the protrusions 408 at the inside of the first housing portion 404 are configured to lock into the axially extending groove portion 412 by the force applied by axially oriented spring means so as to hinder rotational movement of the first housing portion 404 in relation to the second housing 406 in an "idle mode". When the first housing portion 404 is pressed towards the second housing portion 406, for example when the tubular light source is mounted in a fixture, the protrusions 408 are released from the vertical groove portions 412, thereby allowing rotational movement. By rotating the first housing portion 404 in relation to the second housing portion 406, the connector pins 414 make contact with conductive receiving means 416 which in turn are connected to the tubular light source, thereby forming a conductive path between the connector pins 414 and the tubular light source.

The rotational force required to engage and release the mechanical connection of the end portions 216 of the connector pins 208 to the spring clips 214 should be smaller than the force required to dismount the tubular light source 102 from the socket 104, otherwise the connector pins 208 may still be connected to the spring clips 214 as the end cap 104 is dismounted from the socket 108. Additionally, the rotational force of the coil springs 206 should not be so high so as to release the end portions 216 of the connector pins 208 from the spring clips 214. Furthermore, the axial force of the coil spring 218 acting on the plate 212 should be larger than the force of the spring clip 214 acting on the end portions 216 of the connector pins 208 in the axial direction. Thereby the end portions 216 of the connector pins 208 are released from the spring clip 214, thus returning the peg 210 to its idle axial position, when no external force is applied.

Even though the invention has been described with reference to specific exemplifying embodiments thereof, many different alterations, modifications and the like will become apparent for those skilled in the art. Also, it should be noted that parts of the disclosed end cap may be omitted, interchanged or arranged in various ways, the end cap yet being able to perform the functionality of the present invention.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. An end cap for a tubular light source comprising:

a first housing portion;

two connector pins at least partly arranged on an outside of the first housing portion and adapted to fit in a socket of a lighting fixture; and a switch assembly comprising a switch element and configured to form a conductive path between the connector pins and the tubular light source only through at least a depression of the switch element in combination with a relative rotational motion of the first housing portion in relation to the tubular light source as the tubular light source is mounted in the fixture.

2. The end cap according to claim 1, further comprising a second housing portion rotationally movable in relation to the first housing portion, wherein the conductive path is formed through a rotation of the second housing portion in relation to the first housing portion when the switch element is depressed.

3. The end cap according to claim 2, wherein the second housing portion is at least partially arranged inside the first housing portion.

4. The end cap according to claim 2, further comprising electrically conductive receiving elements arranged in the second housing portion and configured to receive the connector pins through a relative rotation of the second housing portion with regard to the first housing portion, and wherein the electrically conductive receiving elements are configured to be axially aligned with the connector pins only when the switch element is depressed.

5. The end cap according to claim 1, wherein the switch element is at least partly arranged on the outside of the first housing portion and is a peg protruding in between the two connector pins.

6. The end cap according to claim 2, wherein the second housing portion is connected to the first housing portion by at least one spring element acting in a rotational direction, the at least one spring element being configured to return the relative rotational position of the first and second housing portions to an idle position.

7. The end cap according to claim 2, wherein the tubular light source is mechanically fixed with the second housing portion.

8. The end cap according to claim 4, wherein the electrically conductive receiving elements comprise spring clips.

9. The end cap according to claim 4, wherein the connector pins are cylindrical having an end portion with a larger diameter configured to connect to the electrically conductive receiving elements.

10. A tubular light source comprising:

an illuminator part comprising a plurality of light emitting elements; and at least one end cap according to claim 1 arranged on at least one end of the illuminator part.

11. The tubular light source according to claim 10, further comprising optics configured to mix light.

12. A luminaire comprising:

a tubular light source according to claim 10; and a fixture comprising at least one socket for receiving at least one end cap and for connecting the tubular light source to an electrical power supply.

13. An end cap for a tubular light source, the tubular light source configured to be arranged in a lighting fixture comprising at least one socket, the end cap comprising:

two connector pins adapted to fit in the socket; and a housing portion coupled to said tubular light source such that the tubular light source is rotationally movable in relation to the connector pins, wherein the end cap is configured such that a rotation of the tubular light source in relation to the connector pins initiates a conductive path between the connector pins and the tubular light source.

14. An end cap for a tubular light source comprising:

a first housing portion;

two connector pins at least partly arranged on an outside of the first housing portion and adapted to fit in a socket of a lighting fixture;

a switch assembly comprising a switch element and configured to form a conductive path between the socket and the tubular light source through a relative rotational motion of the first housing portion in relation to the tubular light source as the tubular light source is mounted in the fixture, the assembly comprising a second housing portion including electrically conductive receiving elements configured to receive the connector pins through a relative rotation of the second housing portion with regard to the first housing portion, wherein the electrically conductive receiving elements are configured to be axially aligned with the connector pins only when the switch element is depressed.

* * * * *